US010471754B2

(12) United States Patent
Takahashi et al.

(10) Patent No.: US 10,471,754 B2
(45) Date of Patent: Nov. 12, 2019

(54) THERMAL TRANSFER IMAGE RECEIVING SHEET

(71) Applicant: Tomoegawa Co., Ltd, Tokyo (JP)

(72) Inventors: Hideaki Takahashi, Shizuoka (JP); Shigeki Asai, Shizuoka (JP)

(73) Assignee: Tomoegawa Co., Ltd., Tokyo (JP)

( * ) Notice: Subject to any disclaimer, the term of this patent is extended or adjusted under 35 U.S.C. 154(b) by 0 days.

(21) Appl. No.: 15/916,611

(22) Filed: Mar. 9, 2018

(65) Prior Publication Data

US 2018/0272778 A1 Sep. 27, 2018

(30) Foreign Application Priority Data

Mar. 24, 2017 (JP) ..... 2017-058626

(51) Int. Cl.
*B41M 5/41* (2006.01)
*B41M 5/382* (2006.01)
*B41M 5/52* (2006.01)

(52) U.S. Cl.
CPC ..... *B41M 5/38214* (2013.01); *B41M 5/41* (2013.01); *B41M 5/52* (2013.01); *B41M 2205/02* (2013.01); *B41M 2205/32* (2013.01)

(58) Field of Classification Search
CPC ..... B41M 5/41; B41M 5/42; B41M 5/392; B41M 5/395; B41M 5/40; B41M 5/405
See application file for complete search history.

(56) References Cited

U.S. PATENT DOCUMENTS 4,923,848 A * 5/1990 Akada ..... B41M 5/0256 156/235
5,525,573 A 6/1996 Uemura et al.
6,110,865 A * 8/2000 Hayashi ..... B41M 3/14 503/227
6,162,517 A * 12/2000 Oshima ..... B41M 5/38214 428/40.1
2005/0266185 A1* 12/2005 Sekiya ..... B41M 5/42 428/32.39
2009/0061121 A1* 3/2009 Omata ..... B41M 5/42 428/32.5

FOREIGN PATENT DOCUMENTS

EP 0664223 A1 7/1995
EP 1371497 A2 12/2003
EP 1419896 A2 * 5/2004 ..... B32B 27/32
EP 1419896 A2 5/2004
JP 2006062114 A 3/2006
JP 2010149464 A 7/2010

OTHER PUBLICATIONS

European Patent Office, Search Report issued in European Patent Application No. 18162104.6 dated Aug. 23, 2018, 7 pages.

* cited by examiner

*Primary Examiner* — Scott A Richmond

(74) *Attorney, Agent, or Firm* — Wood Herron & Evans LLP

(57) ABSTRACT

Provided is a thermal transfer image receiving sheet that is thin, resistant to curling, has favorable image quality and has opacity. A thermal transfer image receiving sheet of the present invention at least comprises an ink receiving layer, a first support, an adhesive layer and a second support laminated in that order, wherein the first support and the second support are provided with a foamed layer and a non-foamed skin layer laminated on both sides of the foamed layer.

11 Claims, 2 Drawing Sheets

THERMAL TRANSFER IMAGE RECEIVING SHEET

BACKGROUND OF THE INVENTION

Field of the Invention

The present invention relates to a thermal transfer image receiving sheet.

Description of the Related Art

Dye-sublimation printers, namely printers employing a dye-sublimation type thermal transfer recording system, are characterized by generating printed images that demonstrate image quality having extremely high definition, have superior halftone color reproducibility and gradation reproducibility, realize sharpness comparable to that of silver salt photographs, and enable the size of the printer to be made more compact than other full-color printing systems.

In the case of dye-sublimation type thermal transfer recording systems, three colors of sublimation dyes, consisting of yellow, magenta and cyan, or four colors, consisting of the aforementioned three colors and black, are respectively coated onto a film, the dye layer side of a thermal transfer sheet provided with a dye layer of each color (ink ribbon), and an ink receiving layer side of a thermal transfer ink receiving sheet having an ink receiving layer for receiving dye, are superimposed, and the sublimation dye present in the dye layer is made to migrate (transfer) to the ink receiving layer by the heat of a thermal head arranged on the back side of the ink ribbon corresponding to image data. Concentration gradation is controlled by controlling the heating energy of the thermal head. Full-color images are formed by sequentially and repeatedly transferring each color of dye of the ink ribbon.

A known thermal transfer image receiving sheet has an ink receiving layer laminated on one side of a support. In addition, a sticker-type of thermal transfer image receiving sheet is also known that has a release sheet laminated on the other side of a support with a pressure-sensitive adhesive layer interposed there between. Sticker-type thermal transfer image receiving sheets allow other portions to be separated from the release sheet after printing and adhered to an arbitrary object (adherend), and are used in photograph sticker machines and the like.

In recent years, thermal transfer image receiving sheets have been proposed that have improved image quality and opacity by using a layer having cushioning and thermal insulation properties as a support.

A known example of a layer having cushioning and thermal insulation properties is a support employing a three-layer structure provided with a foamed layer and a non-foamed skin layer laminated on both sides of the foamed layer.

Moreover, a thermal transfer image receiving sheet having high-density printing characteristics has been proposed in which a thermal insulation layer is formed by coating on a thermal transfer image receiving sheet having two or more thermal insulation layers containing hollow particles or inorganic fine particles and a single layer of an ink receiving layer laminated in that order (see, for example, Patent Documents 1 and 2).

[Patent Document 1] Japanese Unexamined Patent Application, First Publication No. 2006-62114

[Patent Document 2] Japanese Unexamined Patent Application, First Publication No. 2010-149464

However, in the case of using a support having a three-layered structure provided with a foamed layer and a non-foamed skin layer laminated on both sides of the foamed layer, since the skin layer on the side of the ink receiving layer is more susceptible to the effects of heat of the thermal head than the other skin layer, a difference in thermal contraction occurs between these skin layers. As a result, the thermal transfer image receiving sheet ends up curling inward.

More recently, there are a growing number of users of sticker-type thermal transfer image receiving sheets that store the sheets with a release sheet retained thereto instead of adhered to an adherend. Consequently, there is a tendency to place greater importance on sticker-type thermal transfer image receiving sheets not only in the state in which the release sheet is separated, but also in the state prior to separation of the release sheet.

However, when a thermal transfer image receiving sheet curls as a result of having difficulty in demonstrating resistance to curling due to the presence of a pressure-sensitive adhesive layer, the appearance of the resulting image is impaired. Although curling can be inhibited during the time the release sheet is laminated if a rigid release sheet is used for the release sheet, when inward curling is inadequately inhibited in the ink receiving layer and support, the thermal transfer image receiving sheet ends up curling inward as soon as the release sheet is separated when using the thermal transfer image receiving sheet by adhering to an adherend. Problems such as difficulty in adhering to an adherend occur when the thermal transfer image receiving sheet curls inward in a state in which a pressure-sensitive adhesive layer is present on the back side.

Thus, sticker-type thermal transfer image receiving sheets are required to demonstrate resistance to inward curling both in the state prior to separating the release sheet and in the state in which the release sheet has been separated.

Therefore, although it is possible to conceive a method for inhibiting inward curling after printing by preliminarily forming an outward curl in a long thermal transfer image receiving sheet, this results in increased labor due to an increase in the number of processing steps attributable to forming the outward curl. In addition, since a long thermal transfer image receiving sheet is wound into the shape of a roll on a core in order to form the outward curl, it is necessary to allow the thermal transfer image receiving sheet to stand for a certain period of time, thereby causing a decrease in productivity.

Although the thermal transfer image receiving sheet can be curled outward in a short period of time by processing while heating to a temperature of about, for example, 40° C., this results in problems in terms of equipment investment and electricity costs.

In addition, in the case the thermal transfer image receiving sheet is placed in a dye-sublimation printer as single sheets, it becomes difficult to inhibit inward curling due to the difficulty in forming outward curls in the individual thermal transfer image receiving sheets.

As described in Patent Documents 1 and 2, although the coating of a thick film is required to form a thermal insulation layer by coating, not only is it difficult to form a thermal insulation layer of adequate thickness with a single coating, but the production work for this purpose is excessively complex.

In this manner, it is difficult to satisfy curling characteristics while simultaneously satisfying image quality and opacity.

Although curling can be inhibited to a certain degree by increasing the thickness of the support due to the resulting increase in rigidity, in the case of a sticker-type thermal transfer image receiving sheet, limitations are set on total thickness due to the mechanical limitations of photograph sticker machines. Accordingly, in the case of sticker-type thermal transfer image receiving sheets in particular, it is necessary to satisfy curling characteristics together with image quality and opacity within a limited total thickness.

SUMMARY OF THE INVENTION

An object of the present invention is to provide a thermal transfer image receiving sheet that is thin, resistant to curling, demonstrates favorable image quality, and has opacity.

The present invention includes the aspects indicated below.

[1] A thermal transfer image receiving sheet comprising the lamination of an ink receiving layer, a first support, an adhesive layer and a second support in that order; wherein, the first support and the second support are provided with a foamed layer and a non-foamed skin layer laminated on both sides of the foamed layer.

[2] The thermal transfer image receiving sheet described in [1], wherein the total thickness of the foamed layers in the first support and the second support is 60 μm to 150 μm.

[3] The thermal transfer image receiving sheet described in [1] or [2], wherein a pressure-sensitive adhesive layer and a release sheet are laminated on the side of the second support opposite from the adhesive layer in that order.

[4] The thermal transfer image receiving sheet described in any of [1] to [3], wherein the thicknesses of the first support and the second support are each 25 μm to 60 μm, and the total thickness thereof is 280 μm or less.

The thermal transfer image receiving sheet of the present invention is thin, resistant to curling, demonstrates favorable image quality, and has opacity.

DETAILED DESCRIPTION OF THE PREFERRED EMBODIMENTS

The following provides an explanation of the thermal transfer image receiving sheet of the present invention by indicating embodiments thereof with reference to the attached drawings.

First Embodiment

Figure 1:
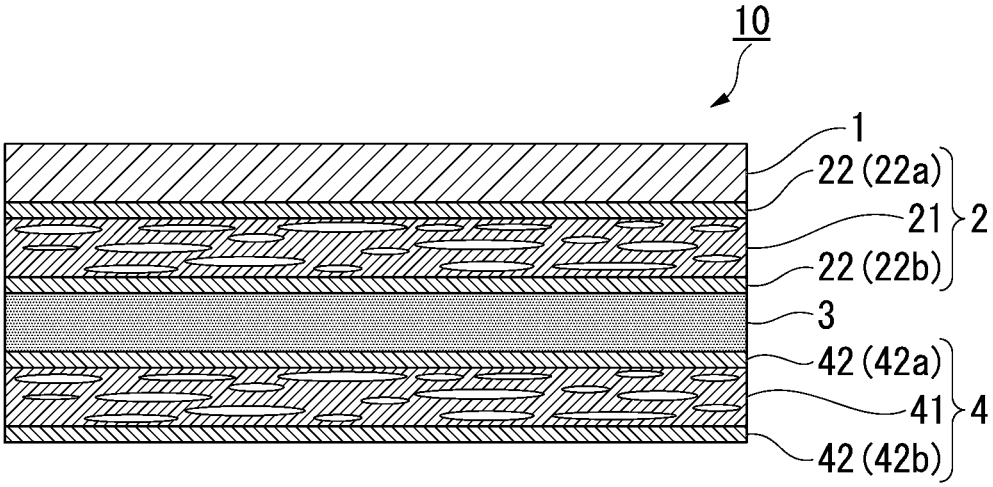
FIG. 1 is a schematic cross-sectional view showing a thermal transfer image receiving sheet of a first embodiment of the present invention.

FIG. 1 is a schematic cross-sectional view showing a thermal transfer image receiving sheet of a first embodiment of the present invention.

A thermal transfer image receiving sheet 10 of the present embodiment has a configuration in which an ink receiving layer 1, a first support 2, an adhesive layer 3 and a second support 4 are laminated in that order.

Although the thickness of the entire thermal transfer image receiving sheet 10 (total thickness) can be set as is suitable, it is typically within the range of 160 μm to 600 μm. If the total thickness of the thermal transfer image receiving sheet 10 is within the aforementioned range, conveyance of the sheet through a printer, cutter adaptability and the like are favorable.

Furthermore, the ratio of each layer and manner of foaming (porosity) of the foamed layers in the thermal transfer image receiving sheet 10 in FIG. 1 are merely shown for convenience and are not limited thereto, but rather can be selected and designed as desired. This applies similarly to other embodiments to be subsequently described.

(Ink Receiving Layer)

The ink receiving layer 1 is a layer for receiving dye from a thermal transfer sheet.

There are no particular limitations on the ink receiving layer 1 and may be similar to a known ink receiving layer.

The ink receiving layer 1 normally contains a binder resin for fixing the dye. The ink receiving layer 1 may further contain a release agent for preventing thermal fusion with the heat transfer sheet when forming an image in addition to the aforementioned binder resin. The ink receiving layer 1 may also further contain other components in addition to the aforementioned binder resin and release agent as necessary.

Examples of binder resins include polyolefin resins (such as polyethylene or polypropylene), vinyl-based resins (such as polyvinyl chloride, polyvinylidene chloride or other halogenated resins, polyvinyl acetate, polyacrylic esters or copolymers thereof), polyester-based resins (such as polyethylene terephthalate or polybutylene terephthalate), polystyrene-based resins, polyamide-based resins, copolymers of olefins (such as ethylene or propylene) and other vinyl-based monomers, ionomers and cellulose derivatives either alone or as mixtures thereof. Among these, halogenated resins and vinyl chloride-vinyl acetate copolymer resins are preferable from the viewpoint of demonstrating superior releasability from the thermal transfer sheet.

The content of binder resin is preferably 90% by weight or more based on the total weight of the ink receiving layer 1, and may be 100% by weight.

Examples of release agents include silicone oil, phosphate ester-based plasticizers and fluorine-based compounds. Among these, silicone oil is preferable from the viewpoint of cost and long-term stability. The silicone oil may be straight silicone oil or modified silicone oil.

The content of the release agent is preferably 0.01 parts by weight to 20 parts by weight based on 100 parts by weight of binder resin. If the content of the release agent is less than the aforementioned lower limit value, adequate release effects are unable to be demonstrated resulting in the risk of the ink receiving layer 1 thermally fusing to the thermal transfer sheet during image formation. If the content of release agent exceeds the aforementioned upper limit value, there is the risk of excess release agent seeping onto the surface.

Examples of components able to be used as components that may be contained as necessary include fluorescent whitening agents, pigments, dyes, charge control agents and various other types of additives.

For example, an additive such as a fluorescent whitening agent, pigment or dye can be contained in the ink receiving layer 1 for the purpose of adjusting the color tone of the thermal transfer image receiving sheet 10. A charge control agent can be contained in the ink receiving layer 1 for the purpose of preventing the thermal transfer image receiving sheet 10 from becoming excessively charged.

The basis weight of the ink receiving layer 1 is preferably 0.5 g/m$^2$ to 6.0 g/m$^2$ and more preferably 1.5 g/m$^2$ to 5.0 g/m$^2$. In the case the basis weight of the ink receiving layer 1 is less than the aforementioned lower limit value, the thermally transferred ink cannot be completely retained resulting in the risk of a decrease in image density and the occurrence of bleeding. If the basis weight of the ink receiving layer 1 exceeds the aforementioned upper limit value, the amount of ink applied in a single coating when forming the ink receiving layer 1 is excessively large and it becomes difficult to control the coating thereof, thereby resulting in the risk of the thickness and smoothness of the thermal transfer image receiving layer 10 becoming uneven. In addition, a considerable amount of coating material is wasted during use, thereby resulting in higher costs.

(First Support)

The first support 2 is provided with a foamed layer 21 and a non-foamed skin layer 22 laminated on both sides of the foamed layer 21.

Furthermore, the skin layer 22 on one side of the foamed layer 21 is referred to as the "one skin layer 22*a*", while the skin layer 22 on the other side of the foamed layer 21 is referred to as the "other skin layer 22*b*".

The foamed layer 21 is a layer that has voids (bubbles) therein.

Examples of materials that compose the foamed layer 21 include resins such as polyethylene, polymethylpentene, polystyrene, polyethylene terephthalate (PET), polybutylene terephthalate, polyethylene naphthalate, polyamide, polyimide, polyvinyl chloride, polyvinylidene chloride, polyvinyl alcohol, ethylene-vinyl alcohol copolymer, polycarbonate, polymethyl methacrylate, polybutene-1, polyether ethyl ketone, polysulfone, polyether sulfone, polyetherimide or polyphenylene sulfide. One type of resin or two or more types of resins may be used to compose the foamed layer 21. Among the aforementioned resins, PET is preferable from the viewpoints of heat resistance and versatility.

A conventionally known method can be used to form voids within the foamed layer 21, and examples thereof include a method consisting of incorporating a filler in the material used to compose the foamed layer 21 to form a sheet followed by stretching the resulting sheet to form voids at the interface between the filler and resin, a method consisting of incorporating a foaming agent in the material used to compose the foamed layer 21 and generating air bubbles by thermal decomposition of the foaming agent, and a method consisting of incorporating a soluble resin in the material used to compose the foamed layer 21 followed by eluting the soluble resin.

The porosity of the foamed layer 21 is preferably 8% to 35%, more preferably 10% to 25%, and even more preferably 17% to 18%. If the porosity of the foamed layer 21 is equal to or greater than the aforementioned lower limit value, image quality and opacity can be maintained more favorably. If the porosity of the foamed layer 21 is equal to or less than the aforementioned upper limit value, the thermal transfer image receiving sheet 10 is more resistant to curling when printed.

The porosity of the foamed layer 21 can be measured in the manner indicated below.

First, a cross-section of the first support 2 is photographed in the direction of thickness with an electron microscope. Next, the resulting image is binarized using image processing software. The ratio of the area of the porous portion of the foamed layer 21 to the cross-sectional area of the foamed layer 21 is calculated in the binarized image.

Photographing a cross-section of the first support 2 with an electron microscope is carried out so as to contain a region extending ±25% from the center of the foamed layer 21 in the direction of thickness.

The ratio of the area of the porous portion is calculated for two arbitrary locations and the average value thereof is taken to be the porosity of the foamed layer 21.

The thickness of the foamed layer 21 is preferably 10 μm to 100 μm, more preferably 20 μm to 95 μm, and even more preferably 30 μm to 90 μm. If the thickness of the foamed layer 21 is equal to or greater than the aforementioned lower limit value, cushioning and thermal insulation properties of the first support 2 are superior and there is greater resistance to the occurrence of uneven density (uneven contrast) in the resulting images. In addition, the rigidity of the thermal transfer image receiving sheet increases. If the thickness of the foamed layer 21 is equal to or less than the aforementioned upper limit value, lamination adaptability with the second support 4 becomes favorable, thereby making it possible to contribute to reduced thickness of the thermal transfer image receiving sheet.

The skin layers 22 are layers that are substantially free of internal voids (air bubbles).

Here, "substantially free of voids (air bubbles)" refers to porosity of less than 1%.

Examples of materials that compose the skin layers 22 include the same materials as those listed as examples of materials that compose the foamed layer 21.

The thickness of the skin layers 22 is preferably 0.5 μm to 20 μm and more preferably 1 μm to 10 μm.

If the thickness of the skin layers 22 is equal to or greater than the aforementioned lower limit value, there is greater resistance to the occurrence of uneven image density. In addition, there is less likelihood of voids in the foamed layer 21 being exposed on the surface and less likelihood of a loss of smoothness. If the thickness of the skin layers 22 is equal to or less than the aforementioned upper limit value, cushioning properties of the foamed layer 21 are demonstrated more effectively and it becomes easier to obtain images having a low level of uneven density.

In the first support 2, the one skin layer 22*a* and the other skin layer 22*b* may be of the same type or different types.

A commercially available product can be used for the first support 2, and examples thereof include polypropylene foam sheets (OPP foam) in the form of Yupo Synthetic Paper (Oji Yuka Goseishi Co., Ltd.), Toyopearl SS (Toyo Boseki Co., Ltd.), Pylen Film (Toyo Boseki Co., Ltd.), Pearlized Film (Futamura Chemical Co., Ltd.), Econeige (Mitsui Chemicals Tocello, Inc.), Crisper (Toyo Boseki Co., Ltd.), W-900 (Diafoil Hoechst Co., Ltd.) and E-60 (Toray Industries, Inc.). Among these, Crisper is preferable from the viewpoints of thermal insulation properties, while Toyopearl SS, Pearlized Film and Econeige are preferable from the viewpoint of cushioning properties.

The overall thickness of the first support 2 is preferably 15 μm to 140 μm, more preferably 25 μm to 130 μm and even more preferably 35 μm to 110 μm. If the thickness of the first support 2 is equal to or greater than the aforementioned lower limit value, cushioning and thermal insulation properties of the first support 2 are superior and there is greater resistance to the occurrence of uneven image density. In addition, the rigidity of the thermal transfer image receiving sheet 10 increases. If the thickness of the first support 2 is equal to or less than the aforementioned upper limit value, lamination adaptability with the second support 4 becomes favorable, thereby making it possible to contribute to reduced thickness of the thermal transfer image receiving sheet.

(Second Support)

The second support 4 is provided with a foamed layer 41 and a non-foamed skin layer 42 laminated on both sides of the foamed layer 41.

Furthermore, the skin layer 42 on one side of the foamed layer 41 is referred to as the "one skin layer 42*a*", while the skin layer 42 on the other side of the foamed layer 41 is referred to as the "other skin layer 42*b*".

Examples of the foamed layer 41 and the skin layers 42 respectively include the foamed layer 21 and the skin layers 22 exemplified in the first support 2, and preferable aspects thereof are also the same.

In addition, the production method, examples of commercially available products and thickness of the second support 4 are also the same as those of the first support 2.

The second support 4 may be of the same type as the first support 2 or of a different type.

The total thickness of the foamed layer 21 in the first support 2 and the foamed layer 41 in the second support 4 is preferably 50 μm to 200 μm and more preferably 60 μm to 150 μm. If the total thickness is equal to or greater than the aforementioned lower limit value, the thermal transfer image receiving sheet 10 is more resistant to curling when printed. In addition, cushioning and thermal insulation properties demonstrated by the first support 2 and the second support 4 are further improved and there is greater resistance to the occurrence of uneven image density. If the total thickness is equal to or less than the aforementioned upper limit value, a thermal transfer image receiving sheet can be provided that is resistant to uneven image density and demonstrates superior opacity while suppressing total thickness.

The average porosity of the foamed layer 21 in the first support 2 and the foamed layer 41 in the second support 4 is preferably 8% to 35%, more preferably 10% to 25% and even more preferably 17% to 18%.

If the average porosity is equal to or greater than the aforementioned lower limit value, image quality and opacity can be more favorably maintained. If the average porosity is equal to or less than the aforementioned upper limit value, the thermal transfer image receiving sheet 10 is more resistant to curling when printed.

(Adhesive Layer)

The adhesive layer 3 is a layer that adheres the first support 2 and the second support 4.

The adhesive layer 3 is only required to be able to adhere the first support 2 and the second support 4 (and more specifically, the other skin layer 22*b* of the first support 2 and the one skin layer 42*a* of the second support 4), and can be formed using various known adhesives.

The adhesive layer 3 normally contains a binder resin (adhesive main agent). Examples of binder resins include polyurethane-based resins, polyolefin-based resins such as α-olefin-maleic anhydride resin, polyester-based resins, acrylic-based resins, epoxy-based resins, urea-based resins, melamine-based resins, phenol-based resins, vinyl acetate-based resins and cyanoacrylate-based resins. Among these, polyurethane-based resins are preferable.

The binder resin may also be cured (crosslinked) by a curing agent. Curing the binder resin with a curing agent improves adhesive strength and increases heat resistance, thereby making this preferable. Moreover, curling of the thermal transfer image receiving sheet is also easily inhibited due to increased rigidity (stiffness). Although isocyanate-based compounds, for example, are typically used for the curing agent, aliphatic amines, cyclic aliphatic amines, aromatic amines or acid anhydrides can also be used.

The basis weight of the adhesive layer 3 is typically 1 $g/m^2$ to 15 $g/m^2$, preferably 1.5 $g/m^2$ to 10 $g/m^2$, and more preferably 2 $g/m^2$ to 6 $g/m^2$. If the basis weight of the adhesive layer 3 is less than the aforementioned lower limit value, there is a mixture of sites where the adhesive layer 3 is adhered to the first support 2 and the second support 4 and sites where it is not adhered (namely, point adhesion instead of planar adhesion), thereby resulting in the risk of inadequate contact of the adhesive layer 3 with the first support 2 and the second support 4. In addition, since voids occur at sites where the respective members are not adhered, variations occur in the manner in which heat is transferred, resulting in the increased likelihood of uneven contrast and decreased image quality. If the basis weight of the adhesive layer 3 exceeds the aforementioned upper limit value, since it becomes difficult for the cushioning effects of the second support 4 to be conveyed to the uppermost surface of the ink receiving layer 1, uneven contrast appears easily and there is the risk of decreased image quality. In addition, when producing the thermal transfer image receiving sheet 10, it becomes difficult to completely evaporate the liquid medium present in the coating material used to form the adhesive layer to be subsequently described, thereby resulting in the risk of organic solvent remaining in the thermal transfer image receiving sheet.

(Method for Producing Thermal Transfer Image Receiving Sheet)

Although there are no particular limitations on the method used to produce the thermal transfer image receiving sheet 10, an example thereof includes a production method having the following steps (a1) to (a3):

(a1) a step for forming the ink receiving layer 1 on the surface of the first support 2 on the side of the one skin layer 22*a*, (a2) a step for forming the adhesive layer 3 on the surface of the second support 4 on the side of the one skin layer 42*a*, and (a3) a step for laminating the surface of the first support 2 on the side of the other skin layer 22*b* with the surface of the second support 4 having the adhesive layer 3 formed thereon on the side of the adhesive layer 3.

[Step (a1)]

A commercially available product may be used for the first support 2 or that produced according to a known production method may be used.

Examples of commercially available products of the first support 2 are the same as the examples of commercially available products listed in the explanation of the first support 2.

Examples of methods for producing the first support 2 include methods (i) to (iii) described below. Furthermore, in the following methods (i) to (iii), filler is incorporated in the material that composes the foamed layer 21, and the foamed layer 21 is foamed by stretching.

(i) A method consisting of melting and extruding the material and filler that compose the foamed layer 21 from an extruding machine and melting and extruding the material that composes the skin layers 22 from a different extruding machine followed by lamination and stretching thereof.

(ii) A method consisting of molding the material and filler that compose the foamed layer 21 into the form of a sheet and laminating the materials that compose the skin layers 22 on both sides of the resulting sheet by melt extrusion followed by stretching.

(iii) A method consisting of separately molding the material and filler that compose the foamed layer 21 and the materials that compose the skin layers 22 into the form of sheets, and laminating the sheet composed of the materials that compose the skin layers 22 onto both sides of the sheet composed of the material that composes the foamed layer 21 followed by stretching.

The ink receiving layer 1 can be formed by coating a coating material for forming the ink receiving layer containing, for example, a binder resin, liquid medium and, as necessary, a release agent and other components, onto the surface of the first support 2 on the side of the one skin layer 22*a* followed by drying. The binder resin, release agent and other components are each the same as those exemplified in the explanation of the ink receiving layer 1. Examples of the liquid medium include water and organic solvent.

Coating of the coating material for forming the ink receiving layer can be carried out by a known coating method. Examples thereof include methods using a known coating device such as a bar coater, wire bar coater, microgravure coater, gravure coater, comma coater, blade coater, air knife coater, gate roll coater, curtain coater, spray coater or die coater.

[Step (a2)]

A commercially available product may be used for the second support 4 or that produced according to a known production method may be used.

Examples of commercially available products of the second support 4 are the same as the examples of commercially available products listed in the explanation of the first support 2.

The method for producing the second support 4 is the same as the method for producing the first support 2.

The adhesive layer 3 can be formed by coating a coating material for forming the adhesive layer containing, for example, the aforementioned binder resin (adhesive main agent), liquid medium and, as necessary, a curing agent, onto the surface of the second support 4 on the side of the one skin layer 42*a* followed by drying. The binder resin and curing agent are each the same as those exemplified in the explanation of the adhesive layer 3. Examples of the liquid medium include water and organic solvent.

Coating of the coating material for forming the adhesive layer can be carried out using a known coating method in the same manner as coating of the coating material for forming the ink receiving layer.

[Step (a3)]

Lamination of the surface of the first support 2 on the side of the other skin layer 22*b* and the surface of the second support 4 having the adhesive layer 3 formed thereon on the side of the adhesive layer 3 can be carried out by a known lamination method such as dry lamination, wet lamination, thermal lamination, hot melt lamination or extrusion lamination.

Following lamination, post-processing such as cutting, half-cut processing, drilling holes of an arbitrary shape or perforating may be carried out as necessary.

(Action and Effects)

Since the thermal transfer image receiving sheet 10 is provided with the first support 2 and the second support 4, it is resistant to curling when printed even if thickness is reduced. Moreover, the thermal transfer image receiving sheet 10 has favorable image quality and opacity.

An example of the reason for the resistance to curling is the providing of two layers of supports having a three-layer structure provided with a foamed layer and a non-foamed skin layer laminated on both sides of the foamed layer. In the case of a single support, since the skin layer on the side of the ink receiving layer is more susceptible to the effects of heat from the thermal head of a printer than the other skin layer as was previously described, a difference in thermal contraction occurs between these skin layers, thereby causing the thermal transfer image receiving sheet to curl inward.

In contrast, in the case of providing two layers of supports, in the first support 2, the one skin layer 22*a* is more susceptible to the effects of heat from the thermal head than the other skin layer 22*b*, and a difference in thermal contraction occurs between the one skin layer 22*a* and the other skin layer 22*b*. However, in the second support 4, due to the thermal insulation effects attributable to the foamed layer 21 of the first support 2, not only the other skin layer 42*b*, but also the one skin layer 42*a* are resistant to the effects of heat from the thermal head. Consequently, it is unlikely for a difference in thermal contraction to occur between the one skin layer 42*a* and the other skin layer 42*b*.

In this manner, since the thermal transfer image receiving sheet 10 is provided with three skin layers that are resistant to the effects of heat from the thermal head and is provided with the adhesive layer 3 between the first support 2 and the second support 4, the thermal transfer image receiving sheet 10 has greater rigidity (stiffness) in comparison with the case of being provided with only one support. Consequently, the thermal transfer image receiving sheet 10 is resistant to curling attributable to thermal contraction.

An example of the reason for the favorable image quality and opacity is that the first support 2 and the second support 4 have the foamed layers 21 and 41, respectively. The first support 2 and the second support 4 have superior cushioning and thermal insulation properties due to the presence of the foamed layers 21 and 41. As a result of two layers having cushioning and thermal insulation properties being present beneath the ink receiving layer 1, contact with the thermal head improves and heat is transferred evenly, thereby resulting in the formation of uniform images having a low level of uneven density while also enhancing opacity.

In the case either the foamed layer 21 or the foamed layer 41 is a non-foamed layer, image quality and opacity decrease due to decreased cushioning and thermal insulation properties.

(Other Forms)

The thermal transfer image receiving sheet 10 may also have an antistatic layer (not shown) on the surface of the second support 4 on the side of the other skin layer 42*b* (backmost side of the thermal transfer image receiving sheet 10) as necessary.

Moreover, the thermal transfer image receiving sheet 10 may also have an anchor layer (not shown) between the other skin layer 42*b* and the antistatic layer.

The antistatic layer is the same as the antistatic layer of the fourth embodiment to be subsequently described, and the anchor layer is the same as the anchor layer of the second embodiment to be subsequently described.

In addition, the thermal transfer image receiving sheet 10 may also have one or more layers of a support (other support) other than the first support 2 and the second support 4 on the surface of the second support 4 on the side of the other skin layer 42*b* (backmost side of the thermal transfer image receiving sheet 10) as necessary.

Examples of the other support include that provided with a foamed layer and a non-foamed skin layer laminated on both sides of the foamed layer. Examples of the foamed layer and skin layers include examples of the foamed layer 21 and the skin layers 22 listed in the explanation of the first support 2, and preferable aspects thereof are also the same.

The other support may be of the same type as the first support 2 or of a different type.

In the case the thermal transfer image receiving sheet 10 has another support, the total thickness of foamed layers in all supports composing the thermal transfer image receiving sheet 10 is preferably 50 μm to 200 μm and more preferably 60 μm to 150 μm. In addition, the average porosity of the foamed layers of all supports composing the thermal transfer image receiving sheet 10 is preferably 8% to 35%, more preferably 10% to 25% and even more preferably 17% to 18%.

Second Embodiment

Figure 2:
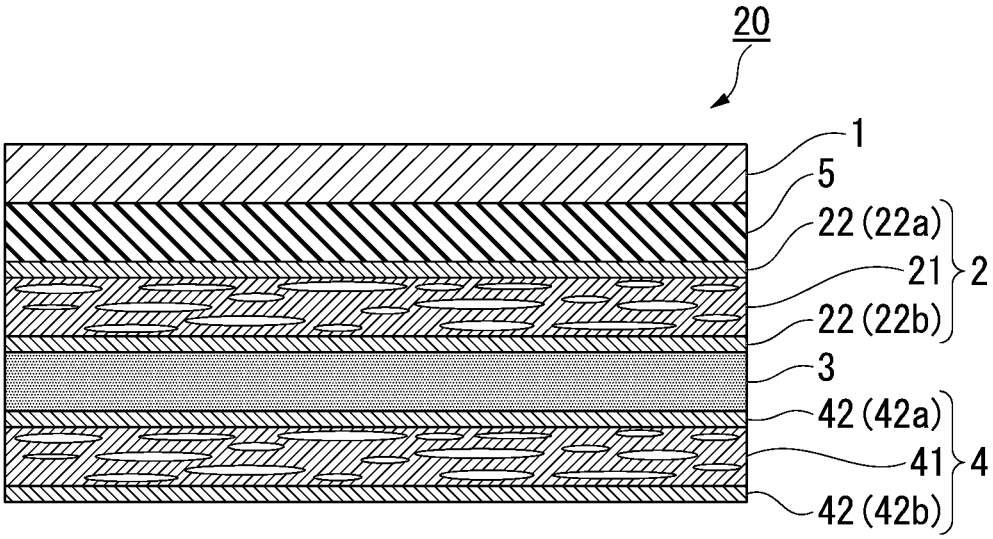
FIG. 2 is a schematic cross-sectional view showing a thermal transfer image receiving sheet of a second embodiment of the present invention.

FIG. 2 is a schematic cross-sectional view of a thermal transfer image receiving sheet of a second embodiment of the present invention. Furthermore, the same reference symbols are used to indicate those constituents of the second embodiment indicated below that correspond to first embodiment, and a detailed explanation thereof is omitted.

A thermal transfer image receiving sheet 20 of the present embodiment has a configuration in which an ink receiving layer 1, an anchor layer 5, a first support 2, an adhesive layer 3 and a second support 4 are laminated in that order.

The thermal transfer image receiving sheet 20 is the same as the thermal transfer image receiving sheet 10 of the first embodiment with the exception of being further provided with the anchor layer 5 between the ink receiving layer 1 and the first support 2.

The preferable range of the overall thickness (total thickness) of the thermal transfer image receiving sheet 20 is the same as that of the thermal transfer image receiving sheet 10.

(Anchor Layer)

The anchor layer 5 is a layer for enhancing adhesion between the ink receiving layer 1 and the one skin layer 22*a* of the first support 2. As a result of enhancing adhesion between the ink receiving layer 1 and the one skin layer 22*a*, there is less likelihood of the occurrence of problems such as separation of the ink receiving layer 1 when subjected to heat from the thermal head of a dye-sublimation printer.

A layer obtained by curing a thermoplastic resin, thermosetting resin or thermoplastic resin having a functional group using various types of curing agents or other methods can be used for the anchor layer 5. More specifically, a resin can be used that is obtained by curing a polyester, chlorinated polypropylene, modified olefin, polyurethane-based resin, acrylic-based resin, ionomer or prepolymer containing a monofunctional and/or multifunctional hydroxyl group with an isocyanate and the like.

The basis weight of the anchor layer 5 is preferably 0.1 $g/m^2$ to 2 $g/m^2$.

(Method for Producing Thermal Transfer Image Receiving Sheet)

The thermal transfer image receiving sheet 20 can be produced according to the same production method as that of the thermal transfer image receiving sheet 10 with the exception of forming the anchor layer 5 on the surface of the first support 2 on the side of the one skin layer 22*a* prior to forming the ink receiving layer 1.

The anchor layer 5 can be formed by coating a coating material for forming the anchor layer, containing a thermoplastic resin, thermosetting resin or thermoplastic resin having a functional group, a liquid medium and, as necessary, a curing agent, followed by drying and curing as necessary.

Coating of the coating material for forming the anchor layer can be carried out by a known coating method in the same manner as coating of the coating material for forming the ink receiving layer.

(Action and Effects)

Since the thermal transfer image receiving sheet 20 is provided with the first support 2 and the second support 4, it is resistant to curling when printed even if thickness is reduced. Moreover, the thermal transfer image receiving sheet 20 has favorable image quality and opacity.

Other Embodiments

The thermal transfer image receiving sheet 20 may also have an antistatic layer (not shown) on the surface of the second support 4 on the side of the other skin layer 42*b* (backmost surface of the thermal transfer image receiving sheet 20) as necessary. Moreover, the thermal transfer image receiving sheet 20 may further have an anchor layer (not shown) between the other skin layer 42*b* and the antistatic layer.

The antistatic layer is the same as the antistatic layer of the fourth embodiment to be subsequently described. The anchor layer 5 is the same as the anchor layer 5 provided between the ink receiving layer 1 and the first support 2.

In addition, the thermal transfer image receiving sheet 20 may also have one or more layers of a support (other support) other than the first support 2 and the second support 4 on the surface of the second support 4 on the side of the other skin layer 42*b* (backmost side of the thermal transfer image receiving sheet 20) as necessary.

The other support is the same as the other support exemplified in the first embodiment.

In the case the thermal transfer image receiving sheet 20 has another support, the total thickness of foamed layers in all supports composing the thermal transfer image receiving sheet 20 is preferably 50 μm to 200 μm and more preferably 60 μm to 150 μm. In addition, the average porosity of the foamed layers of all supports composing the thermal transfer image receiving sheet 20 is preferably 8% to 35%, more preferably 10% to 25% and even more preferably 17% to 18%.

Third Embodiment

Figure 3:
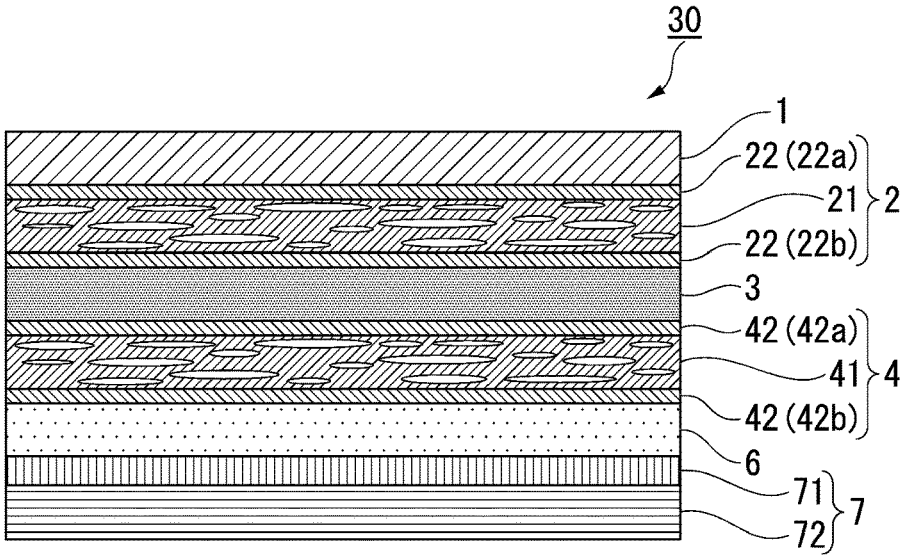
FIG. 3 is a schematic cross-sectional view showing a thermal transfer image receiving sheet of a third embodiment of the present invention.

FIG. 3 is a schematic cross-sectional view of a thermal transfer image receiving sheet of a third embodiment of the present invention.

A thermal transfer image receiving sheet 30 of the present embodiment has a configuration in which an ink receiving layer 1, a first support 2, an adhesive layer 3, a second support 4, a pressure-sensitive adhesive layer 6 and a release sheet 7 are laminated in that order.

The thermal transfer image receiving sheet 30 is the same as the thermal transfer image receiving sheet 10 of the first embodiment with the exception of being further provided with the pressure-sensitive adhesive layer 6 and the release sheet 7 on the surface of the second support 4 on the side of the other skin layer 42*b*.

The thermal transfer image receiving sheet 30 is a sticker type of thermal transfer image receiving sheet.

Although the overall thickness (total thickness) of the thermal transfer image receiving sheet 30 can be set as is suitable, it is typically within the range of 60 μm to 600 μm.

If the total thickness of the thermal transfer image receiving sheet 30 is within the aforementioned range, conveyance of the sheet through a printer, cutter adaptability and the like are favorable. In particular, in the case the thermal transfer image receiving sheet 30 is used in a photograph sticker machine, the thickness of the thermal transfer image receiving sheet 30 is preferably 280 μm or less and more preferably 200 μm to 280 μm due to limitations on the machine.

The thickness of the first support 2 and the second support 4 is preferably 15 μm to 140 μm, more preferably 25 μm to 130 μm, and even more preferably 35 μm to 110 μm, respectively. If the thickness of each support is equal to or greater than the aforementioned lower limit value, cushioning and thermal insulation properties of each support are superior, and there is greater resistance to the occurrence of uneven density (uneven contrast) in the resulting images. In addition, the rigidity of the thermal transfer image receiving sheet 30 increases. If the thickness of each support is equal to or less than the aforementioned upper limit value, lamination adaptability with the release sheet 7 becomes favorable. In particular, in the case of using the thermal transfer image receiving sheet 30 in a photograph sticker machine, the thickness of the first support 2 and the second support 4 is preferably 25 μm to 60 μm, respectively, due to limitations on the machine.

(Release Sheet)

The release sheet 7 has a configuration in which a release layer 71 and a base material 72 are laminated in that order, and the surface thereof on the side of the release layer 71 contacts the pressure-sensitive adhesive layer 6.

The release layer 71 is a layer having the function of enabling separation from the pressure-sensitive adhesive layer 6.

There are no particular limitations on the material composing the release layer 71 provided the release layer 71 demonstrates the aforementioned function, and examples thereof include silicone-based release agents, composed mainly of polymethylsiloxane and the like, and polyolefins.

The basis weight of the release layer 71 is preferably 0.01 $g/m^2$ to 1.0 $g/m^2$.

The base material 72 is preferably that which does not significantly impair the smoothness of the surface of the thermal transfer image receiving sheet 30 (and particularly on the back side opposite from the ink receiving layer 1), and the back side in particular may be subjected to surface roughening processing and the like to facilitate conveyance of the sheet. Overall stiffness of the thermal transfer image receiving sheet 30 can be taken into consideration when selecting the base material 72.

Specific examples of the base material 72 include polymer film, paper, nonwoven fabric and woven fabric. Examples of polymer film include resin films composed of resins such as polyethylene, polymethylpentene, polystyrene, polyethylene terephthalate, polybutylene terephthalate, polyethylene naphthalate, polyamide, polyimide, polyvinyl chloride, polyvinylidene chloride, polyvinyl alcohol, ethylene-vinyl alcohol copolymer, polycarbonate, polymethyl methacrylate, polybutene-1, polyether ethyl ketone, polysulfone, polyether sulfone, polyetherimide or polyphenylene sulfide.

Since a certain degree of stiffness facilitates separation when separating the pressure-sensitive adhesive layer 6 and the release layer 71, the thickness of the base material 72 is preferably 30 μm or more and more preferably 80 μm or more. There are no particular limitations on the upper limit of thickness of the base material 72, and thickness can be increased within a range that does not affect the passage of the thermal transfer image receiving sheet 30 through a printer.

(Pressure-Sensitive Adhesive Layer)

The pressure-sensitive adhesive layer 6 is a layer for pressure-sensitive adhesion between the second support 4 and the release sheet 7.

The pressure-sensitive adhesive layer 6 is only required to be able to adhere the second support 4 and the release sheet 7 (and more specifically, the other skin layer **42*b* of the second support 4 and the release layer 71 of the release sheet 7**), and can be formed using various known pressure-sensitive adhesives.

The pressure-sensitive adhesive layer 6 normally contains a binder resin (adhesive main agent). Examples of binder resins include vinyl acetate resin, acrylic-based resins, vinyl acetate-acrylic copolymers, vinyl acetate-vinyl chloride copolymers, ethylene-vinyl acetate copolymers and polyurethane resin as well as natural rubber, chloroprene rubber and nitrile rubber. Among these, acrylic-based resins are preferable.

The binder resin may also be cured (crosslinked) by a curing agent. Curing the binder resin improves adhesive strength and increases heat resistance, thereby making this preferable. Moreover, curling of the thermal transfer image receiving sheet is also easily inhibited due to increased rigidity (stiffness). Although isocyanate-based compounds, for example, are typically used for the curing agent, epoxy-based crosslinking agents, amine-based crosslinking agents, imine-based crosslinking agents or peroxide-based crosslinking agents can also be used.

The pressure-sensitive adhesive layer 6 may further contain other components in addition to a pressure-sensitive adhesive and curing agent. Examples of other components include tackifiers, plasticizers, fillers (such as glass fibers, glass beads, metal powder or other inorganic powder), pigments, colorants, antioxidants, ultraviolet absorbers, charge control agents and silane coupling agents.

The adhesive strength required of the pressure-sensitive adhesive layer 6 of the thermal transfer image receiving sheet 30 differs according to the application of the thermal transfer image receiving sheet 30. For example, there are cases in which the type of pressure-sensitive adhesive layer is required to be of the permanently adhered (strong adhesive) type that prevents re-separation when adhered to an arbitrary object (adherend), as well as cases in which a re-separable (weakly adhesive) type is required that permits re-separation.

The pressure-sensitive adhesive layer 6 may be of the permanently adhered type or re-separable type. The type of the pressure-sensitive adhesive layer 6 can be suitably set according to the application of the thermal transfer image receiving sheet 30.

The adhesive strength of the pressure-sensitive adhesive layer 6 and whether the pressure-sensitive adhesive layer 6 is of the permanently adhered type or re-separable type can be adjusted according to such factors as the type of pressure-sensitive adhesive component, the type of monomer used to form the pressure-sensitive adhesive component, the ratio between the main monomer and co-monomer, the type and ratio of functional group-containing monomers, or the content of the crosslinking agent component.

The basis weight of the pressure-sensitive adhesive layer 6 is typically 3.0 $g/m^2$ to 40 $g/m^2$, preferably 5.0 $g/m^2$ to 20.0 $g/m^2$, and more preferably 6.0 $g/m^2$ to 15.0 $g/m^2$. If the basis weight of the pressure-sensitive adhesive layer 6 is equal to or greater than the aforementioned lower limit value, tackiness at low temperatures is more easily maintained, and adhesive strength to an adherend is more easily retained. If the basis weight of the pressure-sensitive adhesive layer 6 is equal to or less than the aforementioned upper limit value, seepage of pressure-sensitive adhesive from the ends of the sheet can be more effectively inhibited when the thermal transfer image receiving sheet 30 is produced or printed, thereby allowing the obtaining of images having fewer printing defects. In addition, this is also advantageous in terms of production cost.

(Method for Producing Thermal Transfer Image Receiving Sheet)

Although there are no particular limitations on the method used to produce the thermal transfer image receiving sheet 30, an example thereof consists of a production method having the following steps (b1) to (b5):

(b1) a step for forming the ink receiving layer 1 on the surface of the first support 2 on the side of the one skin layer 22*a*, (b2) a step for forming the adhesive layer 3 on the surface of the second support 4 on the side of the one skin layer 42*a*, (b3) a step for laminating the surface of the first support 2 on the side of the other skin layer 22*b* with the surface of the second support 4 having the adhesive layer 3 formed thereon on the side of the adhesive layer 3 to form a laminate, (b4) a step for forming the pressure-sensitive adhesive layer 6 on the surface of the laminate on the side of the second support 4, and (b5) a step for laminating the surface of the release sheet 7, having the release layer 71 formed on one side of the base material 72, on the side of the release layer 71 with the surface of the laminate on the side of the pressure-sensitive adhesive layer 6.

Step (b1) is the same as step (a1) of the first embodiment, step (b2) is the same as step (a2) of the first embodiment, and step (b3) is the same as step (a3) of the first embodiment.

[Step (b4)]

The pressure-sensitive adhesive layer 6 can be formed by coating a coating material for forming the pressure-sensitive adhesive layer, containing the aforementioned binder resin (adhesive main agent), liquid medium, and as necessary, a curing agent and other components, onto the surface of the laminate on the side of the second support 4 followed by drying. The binder resin, curing agent and other components are each the same as those listed as examples in the explanation of the pressure-sensitive adhesive layer 6. Examples of the liquid medium include water and organic solvent.

Coating of the coating material for forming the pressure-sensitive adhesive layer can be carried out by a known coating method in the same manner as coating the coating material for forming the ink receiving layer.

[Step (b5)]

The release sheet 7 is obtained by forming the release layer 71 on one side of the base material 72.

The release layer 71 can be formed by coating a coating material for coating the release layer, containing the material used to compose the release layer 71 and a liquid medium, onto one side of the base material 72 followed by drying. Materials composing the release layer 71 are the same as those listed as examples in the explanation of the release layer 71. Examples of the liquid medium include water and organic solvent.

Coating of the coating material for forming the release layer can be carried out by a known coating method in the same manner as coating the coating material for forming the ink receiving layer.

A commercially available product can be used for the release sheet 7. Examples of such commercially available products include PET100X (Lintec Corp.).

Lamination of the surface of the release sheet 7 on the side of the release layer 71 with the surface of the laminate on the side of the pressure-sensitive adhesive layer 6 can be carried out by a known lamination method such as dry lamination, wet lamination, thermal lamination, hot melt lamination or extrusion lamination.

Following lamination, post-processing such as cutting, half-cut processing, drilling holes of an arbitrary shape or perforating may be carried out as necessary.

(Action and Effects)

Since the thermal transfer image receiving sheet 30 is provided with the first support 2 and the second support 4, it is resistant to curling when printed even if thickness is reduced. Moreover, the thermal transfer image receiving sheet 30 has favorable image quality and opacity.

Since the thermal transfer image receiving sheet 30 is resistant to curling when printed, it is resistant to curling and easily adheres to an adherend even if the release sheet is separated when using by adhering the thermal transfer image receiving sheet to an adherend. In addition, since the thermal transfer image receiving sheet 30 easily adheres to an adherend, air bubbles are unlikely to enter between the adherend and the thermal transfer image receiving sheet 30 when adhering, wrinkles are unlikely to form in the thermal transfer image receiving sheet 30, and the appearance of printed images is unlikely to be impaired.

In this manner, the thermal transfer image receiving sheet 30 is resistant to curling both prior to separation of the release sheet as well as after the release sheet has been separated.

In addition, since the thermal transfer image receiving sheet 30 has opacity, it is difficult to see a pattern of an adherend through the thermal transfer image receiving sheet 30 when the release sheet is separated and the thermal transfer image receiving sheet 30 is adhered to an adherend, thereby resulting in a favorable appearance of printed images.

In addition, although there are restrictions on total thickness of thermal transfer image receiving sheets used in photograph sticker machines, the thermal transfer image receiving sheet 30 is resistant to curling even if the thickness thereof is reduced to that which allows it to pass through a photograph sticker machine, thereby making it useful for use in a photograph sticker machine. However, application of the thermal transfer image receiving sheet 30 is not limited thereto, but rather can be used in other applications as well.

Other Embodiments

The thermal transfer image receiving sheet 30 may also have an antistatic layer (not shown) on the surface of the release sheet 7 on the side of the base material 72 (backmost side of the thermal transfer image receiving sheet 30). Moreover, the thermal transfer image receiving sheet 30 may also have an anchor layer (not shown) between the base material 72 and the antistatic layer. In addition, the thermal transfer image receiving layer 30 may have an anchor layer (not shown) between the ink receiving layer 1 and the first support 2.

The antistatic layer is the same as the antistatic layer of a fourth embodiment to be subsequently described, and the anchor layer is the same as the anchor layer of the second embodiment.

In addition, although the release sheet 7 employing a multilayer configuration in which the release layer 71 and the base material 72 are laminated in that order is indicated as an example of the release sheet 7, the release sheet 7 may be a single-layer release sheet provided it has releasability that enables it to be separated from the pressure-sensitive adhesive layer.

In addition, the thermal transfer image receiving sheet 30 may also have one or more layers of a support (other support) other than the first support 2 and the second support 4 between the second support 4 and the pressure-sensitive adhesive layer 6 as necessary.

The other support is the same as the other support exemplified in the first embodiment.

In the case the thermal transfer image receiving sheet 30 has another support, the total thickness of foamed layers in all supports composing the thermal transfer image receiving sheet 30 is preferably 50 μm to 200 μm and more preferably 60 μm to 150 μm. In addition, the average porosity of the foamed layers of all supports composing the thermal transfer image receiving sheet 30 is preferably 8% to 35%, more preferably 10% to 25% and even more preferably 17% to 18%.

Fourth Embodiment

Figure 4:
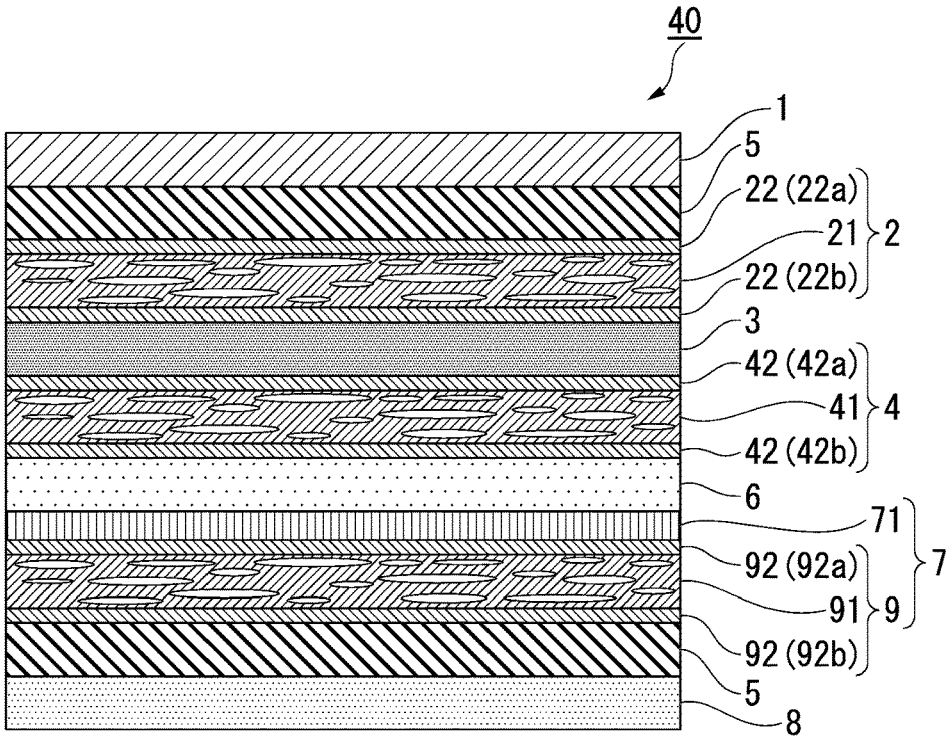
FIG. 4 is a schematic cross-sectional view showing a thermal transfer image receiving sheet of a fourth embodiment of the present invention.

FIG. 4 is a schematic cross-sectional view of a thermal transfer image receiving sheet of a fourth embodiment of the present invention.

A thermal transfer image receiving sheet 40 of the present embodiment has a configuration in which an ink receiving layer 1, an anchor layer 5, a first support 2, an adhesive layer 3, a second support 4, a pressure-sensitive adhesive layer 6, a release sheet 7, an anchor layer 5 and an antistatic layer 8 are laminated in that order.

The thermal transfer image receiving sheet 40 is the same as the thermal transfer image receiving sheet 10 of the first embodiment with the exception of being further provided with the anchor layer 5 between the ink receiving layer 1 and the first support 2, being further provided with the release sheet 7 on the surface of the second support 4 on the side of the other skin layer 42 with the pressure-sensitive adhesive layer 6 interposed there between, and being further provided with the antistatic layer 8 on the release sheet 7 with the anchor layer 7 interposed there between.

The thermal transfer image receiving sheet 40 is a sticker type of thermal transfer image receiving sheet.

The preferable range of the overall thickness (total thickness) of the thermal transfer image receiving sheet 40 is the same as that of the thermal transfer image receiving sheet 30 of the third embodiment.

The preferable range of each thickness of the first support 2 and the second support 4 is the same as that of the thermal transfer image receiving sheet 30 of the third embodiment.

(Release Sheet)

The release sheet 7 of the present embodiment has a configuration in which the release layer 71 and a third support 9 are laminated in that order, and the surface on the side of the release layer 71 contacts the pressure-sensitive adhesive layer 6.

Examples of the release layer 71 include the release layer 71 exemplified in the release sheet 7 of the third embodiment, and preferable aspects thereof are also the same.

The third support 9 is provided with a foamed layer 91 and a non-foamed skin layer 92 laminated on both sides of the foamed layer 91.

Furthermore, the skin layer 92 on one side of the foamed layer 91 is also referred to as the "one skin layer 92*a*", while the skin layer 92 on the other side of the foamed layer 91 is also referred to as the "other skin layer 92*b*".

Examples of the foamed layer 91 and the skin layers 92 respectively include the foamed layer 21 and the skin layers 22 exemplified in the first support 2 of the first embodiment, and preferable aspects thereof are also the same.

In addition, the production method, examples of commercially available products and thickness of the third support 9 are also the same as those of the first support 2.

The third support 9 may be of the same type as the first support 2 or of a different type.

(Pressure-Sensitive Adhesive Layer)

Examples of the pressure-sensitive adhesive layer 6 include the pressure-sensitive adhesive layer 6 of the third embodiment, and preferable aspects thereof are also the same.

(Anchor Layer)

Examples of the anchor layer 5 between the ink receiving layer 1 and the first support 2 as well as the anchor layer 5 between the release sheet 7 and the antistatic layer 8 include the anchor layer 5 of the second embodiment, and preferable aspects thereof are also the same.

(Antistatic Layer)

The antistatic layer 8 is a layer for preventing the thermal transfer image receiving sheet 30 from becoming charged when the thermal transfer image receiving sheet 30 is conveyed through the printer and laminated.

The basis weight of the antistatic layer is preferably 0.01 $g/m^2$ to 2 $g/m^2$.

The antistatic layer normally contains a binder component and an antistatic agent.

Examples of the binder component include polyester resin, polyurethane resin, acrylic resin, epoxy resin, polyamide resin, polyvinyl alcohol resin (PVA), styrene-butadiene copolymer (SBR) and acrylonitrile-butadiene copolymer (NBR). Among these, polyester resin, polyurethane resin and acrylic resin are preferable.

Examples of the antistatic agent include anionic low molecular weight antistatic agents such as carboxylic acids, sulfonates or sulfates, cationic low molecular weight antistatic agents such as quaternary ammonium salts, phosphonium salts or sulfonium salts, nonionic low molecular weight antistatic agents such as polyvalent alcohol derivatives or polyalkylene oxide derivatives, amphoteric antistatic agents, antistatic agents such as boron compounds, nitrogen-containing compounds, sulfur-containing compounds or guanidine salts, complex compound-based antistatic agents, antistatic plasticizers such as aliphatic compounds or aromatic compounds, high molecular weight antistatic agents such as polyethylene oxide, quaternary ammonium salt-containing (meth)acrylate copolymers, sodium polystyrene sulfonate, carbobetain graft copolymers or high molecular weight charge transfer conjugates, nonionic surfactant-type antistatic agents such as glycerin fatty acid esters or polyoxyethylene alkyl ethers, anionic surfactant-type antistatic agents such as alkyl sulfonates or alkylbenzene sulfonates, cationic surfactant-type antistatic agents such as tetraalkylammonium salts or trialkylbenzylammonium salts, amphoteric surfactant-type antistatic agents such as alkyl betaines or alkylimidazolium betaines, electrically conductive polymers such as polyacetylene, polyparaphenylene, polypyrroles, polythiophenes, polyaniline or polyphenylenevinylene, metal fillers such as aluminum, copper, nickel or iron, carbon and electrically conductive carbon whiskers. One type or two or more types of antistatic agents may be used.

The content of antistatic agent is preferably 0.01 parts by weight or more based on 100 parts by weight of the binder component. If the content of the antistatic agent is less than the aforementioned lower limit value, adequate antistatic effects cannot be demonstrated. There is no upper limit on the content of the antistatic agent, and in the case the antistatic agent is of the high molecular weight type and also fulfills the role of a binder component, the antistatic agent may be used instead of the binder component.

(Method for Producing Thermal Transfer Image Receiving Sheet)

Although there are no particular limitations on the method used to produce the thermal transfer image receiving sheet 40, an example thereof consists of a production method having the following steps (c1) to (c7):

(c1) a step for forming the anchor layer 5 on the surface of the first support 2 on the side of the one skin layer 22*a* followed by further forming the ink receiving layer 1 on the anchor layer 5, (c2) a step for forming the adhesive layer 3 on the surface of the second support 4 on the side of the one skin layer 42*a*, (c3) a step for laminating the surface of the first support 2 on the side of the other skin layer 22*b* with the surface of the second support 4, having the adhesive layer 3 formed thereon, on the side of the adhesive layer 3 to obtain a laminate, (c4) a step for forming the pressure-sensitive adhesive layer 6 on the surface of the laminate on the side of the second support 4, (c5) a step for laminating the surface of the release sheet 7, having the release layer 71 formed on the surface of the third support 9 on the side of the one skin layer 92*a*, on the side of the release layer 71 with the surface of the laminate on the side of the pressure-sensitive adhesive layer 6, (c6) a step for forming the anchor layer 5 on the surface of the third support 9 on the side of the other skin layer 92*b*, and (c7) a step for forming the antistatic layer 8 on the exposed side of the anchor layer 5.

Step (c2) is the same as step (a2) of the first embodiment, and step (c3) is the same as step (a3) of the first embodiment. Step (c4) is the same as step (b4) of the third embodiment.

[Step (c1)]

Step (c1) is the same as step (a1) of the first embodiment with the exception of forming the anchor layer 5 on the surface of the first support 2 on the side of the one skin layer 22*a* prior to forming the ink receiving layer 1.

The anchor layer 5 can be formed by coating a coating material for forming the anchor layer, containing a thermoplastic resin, thermosetting resin or thermoplastic resin having a functional group, a liquid medium and, as necessary, a curing agent, on the surface of the first support 2 on the side of the first skin layer 22*a* followed by drying and curing as necessary. The thermoplastic resin, thermosetting resin or thermoplastic resin containing a functional group, and the curing agent, are each the same as the examples thereof listed in the explanation of the anchor layer 5 of the second embodiment. Examples of the liquid medium include water and organic solvent.

Coating of the coating material for forming the anchor layer can be carried out by a known coating method in the same manner as coating the coating material for forming the ink receiving layer.

[Step (c5)]

A commercially available product may be used for the third support 9, and that produced according to a known production method may be used.

Examples of commercially available products of the third support 9 are the same as the commercially available products listed in the explanation of the first support 2 of the first embodiment.

The method for producing the third support 9 is the same as the method for producing the first support 2 of the first embodiment.

The release sheet 7 is obtained by forming the release layer 71 on the surface of the third support 9 on the side of the one skin layer 92*a*.

The method used to form the release layer 71 is the same as that of step (b5) of the third embodiment.

The method used to laminate the surface of the release sheet 7 on the side of the release layer 71 with the surface of the laminate on the side of the pressure-sensitive adhesive layer 6 is the same as that of step (b5) of the third embodiment.

[Step (c6)]

The anchor layer 5 can be formed by, for example, coating the coating material for forming the anchor layer on the surface of the third support 9 on the side of the other skin layer 92*b* followed by drying and curing as necessary.

[Step (c7)]

The antistatic layer 8 can be formed by, for example, coating the coating material for forming the antistatic layer, containing a binder resin, antistatic agent and liquid medium and the like, onto the exposed side of the anchor layer 5 followed by drying and curing as necessary. The binder resin and antistatic agent are each the same as those listed in the explanation of the antistatic layer 8. Examples of the liquid medium include water and organic solvent.

Coating of the coating material for forming the antistatic layer can be carried out by a known coating method in the same manner as coating the coating material for forming the ink receiving layer.

After having formed the antistatic layer 8, post-processing such as cutting, half-cut processing, drilling holes of an arbitrary shape or perforating may be carried out as necessary.

(Action and Effects)

Since the thermal transfer image receiving sheet 40 is provided with the third support 9 in addition to the first support 2 and the second support 4, it is resistant to curling when printed even if thickness is reduced. Moreover, the thermal transfer image receiving sheet 40 has more favorable image quality and superior opacity.

In addition, the thermal transfer image receiving sheet 40 is resistant to curling both prior to separation of the release sheet as well as after the release sheet has been separated, and easily adheres to an adherend when the thermal transfer image receiving sheet 40 is used by adhering to an adherend. Moreover, it is difficult to see a pattern of an adherend through the thermal transfer image receiving sheet 40 when the release sheet is separated and the thermal transfer image receiving sheet 40 is adhered to an adherend, thereby resulting in a favorable appearance of printed images. On the other hand, since the thermal transfer image receiving sheet 40 has superior opacity, the appearance of printed images is favorable even in the case of storing the thermal transfer image receiving sheet 40 while leaving the release sheet attached without adhering to an adherend.

In addition, although the thermal transfer image receiving sheet 40 is useful for use in a photograph sticker machine, application of the thermal transfer image receiving sheet 40 is not limited thereto, but rather can be used in other applications as well.

Other Embodiments

A non-foamed layer may be used instead of the foamed layer 91 in the third support 9. Examples of materials composing the non-foamed layer include the same as those listed as examples of materials composing the foamed layer 91. However, the third support 9 is preferably provided with the foamed layer 91 in consideration of opacity when storing the thermal transfer image receiving sheet 40 while leaving the release sheet attached without adhering to an adherend.

In addition, the thermal transfer image receiving sheet 40 may also have one or more layers of a support other than the first support 2, second support 4 and third support 9 (other support) between the second support 4 and the pressure-sensitive adhesive layer 6 as necessary.

The other support is the same as the other support exemplified in the first embodiment.

In the case the thermal transfer image receiving sheet 40 has another support, the total thickness of foamed layers in all supports located closer to the ink receiving layer than the pressure-sensitive adhesive layer 6 is preferably 50 μm to 200 μm and more preferably 60 μinto 150 μm. In addition, the average porosity of the foamed layers of all supports closer to the ink receiving layer than the pressure-sensitive adhesive layer is preferably 8% to 35%, more preferably 10% to 25% and even more preferably 17% to 18%.

EXAMPLES

Although the following provides a more detailed explanation of the present invention by indicating examples and comparative examples thereof, the present invention is not limited to only these examples.

Furthermore, the porosity of foamed layers was measured in the manner described below, and the thermal transfer image receiving sheets of each example were evaluated in the manner indicated below.

(Measurement of Porosity)

A thermal transfer image receiving sheet was cut in the direction of thickness and a cross-section of the first support was photographed at a magnification of 2000× using a scanning electron microscope (JSM-6460LV, JEOL Ltd.). Next, the resulting image was binarized using image processing software (WinROOF Version 3.61, Mitani Corp.). The ratio of the area of the porous portion to the cross-sectional area of the foamed layer was calculated in the binarized image.

Imaging of the cross-section of the first support with the electron microscope was carried out so as to contain a region extending ±25% from the center of the foamed layer in the direction of thickness, the ratio of the area of the porous portion was calculated for two arbitrary locations, and the average value thereof was taken to be the porosity of the foamed layer.

Porosity of the foamed layer was similarly determined for the second support.

The average of the porosity of the foamed layer in the first support and the porosity of the foamed layer in the second support was then determined.

(Evaluation of Curling Resistance)

A thermal transfer image receiving sheet was cut to a width (short side) of 100 mm and length (long side) of 178 mm for use as an evaluation sheet.

The evaluation sheet was placed in a dye-sublimation thermal transfer printer (Selphy CP910, Canon Corp.) and a gray solid image was printed on the sheet.

Following printing, the degree (size) of curling was confirmed visually while holding the end on the long side or end on the short side of the evaluation sheet between the thumb and index finger with the printed side facing upward so that the evaluation sheet was horizontal and the long side or short side of the evaluation sheet was facing towards the front. The degree of curling when the long side of the evaluation sheet was facing towards the front and the degree of curling wen the short side of the evaluation sheet was facing towards the front were compared, and the height difference between the center of the evaluation sheet in the direction having the greater degree of curling and the end on the long side or end on the short side was measured with a stainless steel ruler, followed by evaluating curling resistance according to the criteria indicated below. Curling resistance was similarly evaluated after having separated the release sheet.

Furthermore, in the case curling when the long side is facing towards the front is greater than curling when the short side is facing towards the front, the height difference was expressed with a negative value when the evaluation sheet had curled such that the end on the short side of the evaluation sheet was located lower than the center of the evaluation sheet (outward curling). Height difference was expressed with a positive value when the evaluation sheet had curled such that the end on the short side of the evaluation sheet was located higher than the center of the evaluation sheet (inward curling).

On the other hand, in the case curling when the short side is facing toward the front is greater than curling when the long side is facing towards the front, the height difference was expressed with a negative value when the evaluation sheet had curled such that the end on the long side of the evaluation sheet was located lower than the center of the evaluation sheet (outward curling). Height difference was expressed with a positive value when the evaluation sheet had curled such that the end on the long side of the evaluation sheet was located higher than the center of the evaluation sheet (inward curling).

(Evaluation Criteria when Release Sheet is Present)

A: Height difference of less than 0 mm

B: Height difference of 0 mm to less than +1 mm

Y: Height difference of +1 mm to less than +3 mm

Z: Height difference of +3 mm or more (Evaluation Criteria in Absence of Release Sheet)

The absence of a release sheet means that the amount of time until the evaluation sheet is adhered to an adherend is short and that appearance at that time is not important. Emphasis is instead placed on the ease of adhesion to the adherend. Thus, the evaluation sheets were evaluated based on height difference criteria when considered from the viewpoint of ease of adhesion.

A: Height difference of less than +5 mm, and able to adhere to the adherend without difficulty B: Height difference of +5 mm to less than +10 mm, and slight difficulty in adhering to the adherend, but not to the extent of causing the formation of air bubbles, wrinkles or other adhesion abnormalities Y: Height difference of +10 mm to less than +15 mm, some difficulty in adhering to the adherend, and potential for causing the formation of air bubbles, wrinkles or other adhesion abnormalities depending on the case Z: Height difference of +15 mm or more, extremely difficult to adhere to the adherend, and high probability of the occurrence of air bubbles, wrinkles or other adhesion abnormalities (Evaluation of Image Quality)

A thermal transfer image receiving sheet was cut to a width (short side) of 100 mm and length (long side) of 178 mm for use as an evaluation sheet.

The evaluation sheet was placed in a dye-sublimation thermal transfer printer (Selphy CP910, Canon Corp.) and a gray solid image was printed on the sheet.

Following printing, the image on the evaluation sheet was confirmed visually and evaluated for contrast unevenness according to the criteria indicated below.

A: Contrast unevenness unable to be confirmed

B: Contrast unevenness to a degree that it can only be confirmed if observed closely Y: Contrast unevenness conspicuous to a degree that impairs image quality Z: Contrast unevenness definitely confirmed to a degree that significantly impairs image quality (Evaluation of Opacity)

A thermal transfer image receiving sheet was cut to a width (short side) of 100 mm and length (long side) of 178 mm for use as an evaluation sheet.

The evaluation sheet was placed in a dye-sublimation thermal transfer printer (Selphy CP910, Canon Corp.) and a gray solid image was printed on the sheet.

Following printing, the degree to which a base (black color) can be seen through when arranged on a black surface with the printed surface of the evaluation sheet facing upward was confirmed visually, and this was used to evaluate opacity according to the criteria indicated below.

A: Unable to see through black color at all

B: Unable to see through black color unless observed closely

Y: Slightly able to be see through black color

Z: Definitely able to see through black color

Example 1

The thermal transfer image receiving sheet shown in FIG. 3 was produced according to the procedure indicated below.

A coating material for forming an ink receiving layer, a coating material for forming an adhesive layer, and a coating material for forming a pressure-sensitive adhesive layer were prepared according to the formulas shown in Table 1. A polyethylene terephthalate film having a thickness of 50 μm (Crisper K1212, Toyo Boseki Co., Ltd., foamed layer thickness: 40 μm, skin layer thickness: 5 μm), having a configuration in which a non-foamed skin layer was formed on both sides of a foamed layer, was used for the first support and the second support. A polyethylene terephthalate film having a thickness of 100 μm (PET100X, Lintec Corp.), having a configuration in which a release layer was formed on a base material, was used for the release sheet.

The coating material for forming an ink receiving layer was coated onto the first support on the side of one skin layer with a wire bar to a coated thickness after drying of 2.5 g/m$^2$ followed by drying to form the ink receiving layer (Step (b1)).

Separate from the above, the coating material for forming an adhesive layer was coated onto the second support on the side of the other skin layer with a wire bar to a coated thickness after drying of 5 g/m$^2$ followed by drying to form the adhesive layer (Step (b2)).

Next, the surface of the first support on the side of the other skin layer and the surface of the second support having the adhesive layer formed thereon on the side of the adhesive layer were laminated followed by drying to obtain a laminate (Step (b3)).

Next, the coating material for forming a pressure-sensitive adhesive layer was coated onto the surface of the laminate on the side of the second support with a wire bar to a coated thickness after drying of 15 g/m$^2$ followed by drying to form the pressure-sensitive adhesive layer (Step (b4)).

Next, the surface of the release sheet on the side of the release layer and the surface of the laminate on the side of the pressure-sensitive adhesive layer were laminated to obtain the thermal transfer image receiving sheet of Example 1.

The resulting thermal transfer image receiving sheet was respectively measured for porosity of the foamed layers in the first support and the second support followed by determining the average value thereof. In addition, curling resistance, image quality and opacity were evaluated. The results are shown in Table 2.

TABLE 1

| | Function | Components | Parts by Weight |
|---|---|---|---|
| Coating material for forming ink receiving layer | Binder resin | Vinyl chloride-vinyl acetate copolymer resin (trade name: Kanevinyl MB1008, Kaneka Corp.) | 100 |
| | Release agent | Alkylaralkyl-modified silicone oil (trade name: X-22-1877, Shin-Etsu Chemical Co., Ltd.) | 5 |
| | Solvent | Methyl ethyl ketone | 200 |
| | Solvent | Toluene | 200 |
| Coating material for forming adhesive layer | Adhesive main agent | Urethane resin (polyol component) (trade name: Takelac A-7, Mitsui Chemicals, Inc.) | 100 |
| | Curing agent | Urethane resin (isocyanate component) (trade name: Takenate A-7, Mitsui Chemicals, Inc.) | 50 |
| | Solvent | Ethyl acetate | 450 |
| Coating material for forming pressure-sensitive adhesive layer | Adhesive main agent | Acrylic resin (trade name: Nissetsu KP-1004, Nippon Carbide Industries Co., Inc.) | 100 |
| | Curing agent | Isocyanate-based crosslinking agent (trade name: Nissetsu CK-101, Nippon Carbide Industries Co., Inc.) | 1.5 |
| | Solvent | Ethyl acetate | 300 |
| Coating material for forming release layer | Release agent | Silicone compound (trade name: KS-3703T, Shin-Etsu Chemical Co., Ltd.) | 100 |
| | Catalyst | Platinum-based catalyst (trade name: CAT-PL-50T, Shin-Etsu Chemical Co., Ltd.) | 1 |

TABLE 1-continued

| | Function | Components | Parts by Weight |
|---|---|---|---|
| | Solvent | Toluene | 500 |
| Coating material for forming layer containing hollow particles | Binder component | Modified styrene-butadiene latex (trade name: LX407F8B, Zeon Corp.) | 100 |
| | Hollow particles | Modified styrene-acrylic hollow particles (trade name: MH8109, Zeon Corp.) | 190 |

Examples 2 to 5

Thermal transfer image receiving sheets were obtained in the same manner as Example 1 with the exception of changing the compositions of the first support and the second support to the compositions shown in Table 2.

The resulting thermal transfer image receiving sheets were respectively measured for porosity of the foamed layers in the first support and the second support followed by determining the average value thereof. In addition, curling resistance, image quality and opacity were evaluated. The results are shown in Table 2.

Furthermore, a polyethylene terephthalate film (Crisper K1211, Toyo Boseki Co., Ltd.) was used for the support having a thickness of 38 μm, and a polyethylene terephthalate film (Crisper K1212, Toyo Boseki Co., Ltd.) was used for the support having a thickness of 75 μm.

Example 6

A coating material for forming an ink receiving layer, a coating material for forming an adhesive layer, a coating material for forming a pressure-sensitive adhesive layer, and a coating material for forming a release layer were prepared according to the formulas shown in Table 1. A polyethylene terephthalate film having a thickness of 100 μm (Crisper K1212, Toyo Boseki Co., Ltd., foamed layer thickness: 86 μm, skin layer thickness: 7 μm), having a configuration in which a non-foamed skin layer was formed on both sides of a foamed layer, was used for the first support and the third support. A polyethylene terephthalate film having a thickness of 75 μm (Crisper K1212, Toyo Boseki Co., Ltd., foamed layer thickness: 63 μm, skin layer thickness: 6 μm), having a configuration in which a non-foamed skin layer was formed on both sides of a foamed layer, was used for the second support.

Steps (b1) to (b4) were carried out in the same manner as Example 1 with the exception of changing the first support and the second support.

Separate from the above, the coating material for forming a release layer was coated onto the surface of the third support on the side of the one skin layer with a wire bar to a coated thickness after drying of 0.3 g/m$^2$ followed by drying to form a release layer and produce a release sheet.

Next, the surface of the release sheet on the side of the release layer and the surface of the laminate on the side of the pressure-sensitive adhesive layer were laminated to obtain the thermal transfer image receiving sheet of Example 6.

The resulting thermal transfer image receiving sheet was respectively measured for porosity of the foamed layers in the first support and the second support followed by determining the average value thereof. In addition, curling resistance, image quality and opacity were evaluated. The results are shown in Table 2.

Comparative Examples 1 and 2

A coating material for forming an ink receiving layer and a coating material for forming a pressure-sensitive adhesive layer were prepared according to the formulas shown in Table 1. A polyethylene terephthalate film having a thickness of 38 μm (Crisper K1211, Toyo Boseki Co., Ltd., foamed layer thickness: 30 μm, skin layer thickness: 4 μm), having a configuration in which a non-foamed skin layer was formed on both sides of a foamed layer, or a polyethylene terephthalate film having a thickness of 188 μm (Crisper K1212, Toyo Boseki Co., Ltd., foamed layer thickness: 160 μm, skin layer thickness: 14 μm), having a configuration in which a non-foamed skin layer was formed on both sides of a foamed layer, was used for the first support.

Step (b1) was carried out in the same manner as Example 1 with the exception of changing the composition of the first support to the composition shown in Table 2.

Next, the coating material for forming a pressure-sensitive adhesive layer was coated onto the surface of the first support on the side of the other skin layer with a wire bar to a coated thickness after drying of 15 g/m$^2$ followed by drying to form a pressure-sensitive adhesive layer.

Next, using the same release sheet as that of Example 1, the surface of the release sheet on the side of the release layer and the surface of the first support having the pressure-sensitive adhesive layer formed thereon on the side of the pressure-sensitive adhesive layer were laminated to obtain the thermal transfer image receiving sheets of Comparative Examples 1 and 2.

The resulting thermal transfer image receiving sheets were respectively measured for porosity of the foamed layers in the first support and the second support followed by determining the average value thereof. In addition, curling resistance, image quality and opacity were evaluated. The results are shown in Table 2.

Comparative Example 3

A coating material for forming an ink receiving layer, a coating material for forming an adhesive layer, a coating material for forming a pressure-sensitive adhesive layer, and a coating material for forming a layer containing hollow particles were prepared according to the formulas shown in Table 1. A polyethylene terephthalate film having a thickness of 100 μm (PET100X, Lintec Corp.), having a configuration in which a release layer was formed on a base material, was used as a release sheet.

A biaxially oriented polypropylene (OPP) film was prepared for use as a separable support. The coating material for forming an ink receiving layer was coated onto the OPP film with a wire bar to a coated thickness after drying of 2.5 g/m$^2$ followed by drying to form an ink receiving layer. The coating material for forming a layer containing hollow particles was coated onto the ink receiving layer with a wire bar to a coated thickness after drying of 10 μm followed by drying to form a first layer containing hollow particles. The coating material for forming an adhesive layer was coated onto the first layer containing hollow particles with a wire bar to a coated thickness after drying of 5 g/m$^2$ followed by drying to form an adhesive layer. The coating material for forming a layer containing hollow particles was coated onto the adhesive layer with a wire bar to a coated thickness after drying of 10 μm followed by drying to forma second layer containing hollow particles. The coating material for forming a pressure-sensitive adhesive layer was coated onto the second layer containing hollow particles with a wire bar to a coated thickness after drying of 15 g/m$^2$ followed by drying to forma pressure-sensitive adhesive layer and obtain a laminate. Furthermore, the first layer containing hollow particles and the second layer containing hollow particles were foamed layers.

Next, the surface of the release sheet on the side of the release layer and the surface of the laminate on the side of the pressure-sensitive adhesive layer were laminated. Finally, the OPP film was separated from the interface with the ink receiving layer to obtain a thermal transfer image receiving sheet.

The resulting thermal transfer image receiving sheet was respectively measured for porosity of the first layer containing hollow particles and the second layer containing hollow particles followed by determining the average value thereof. In addition, curling resistance, image quality and opacity were evaluated. The results are shown in Table 2.

TABLE 2

| | | | | Ex. 1 | Ex. 2 | Ex. 3 | Ex. 4 | Ex. 5 | Ex. 6 | Comp. Ex. 1 | Comp. Ex. 2 | Comp. Ex. 3 |
|---|---|---|---|---|---|---|---|---|---|---|---|---|
| First support | | Foamed layer thickness (μm) | | 40 | 30 | 63 | 30 | 63 | 86 | 30 | 160 | 10 |
| | | Skin layer thickness (μm) | | 5 | 4 | 6 | 4 | 6 | 7 | 4 | 14 | — |
| | | Overall thickness (μm) | | 50 | 38 | 75 | 38 | 75 | 100 | 38 | 188 | 10 |
| Second support | | Foamed layer thickness (μm) | | 40 | 30 | 63 | 63 | 30 | 63 | — | — | 10 |
| | | Skin layer thickness (μm) | | 5 | 4 | 6 | 6 | 4 | 6 | — | — | — |
| | | Overall thickness (μm) | | 50 | 38 | 75 | 75 | 38 | 75 | — | — | 10 |
| Release sheet | | Type | | PET100X | PET100X | PET100X | PET100X | PET100X | Third support | PET100X | PET100X | PET100X |
| | | Overall thickness (μm) | | 100 | 100 | 100 | 100 | 100 | 100 | 100 | 100 | 100 |
| Total thickness of foamed layers in first support and second support (μm) | | | | 80 | 60 | 126 | 93 | 93 | 149 | 30 | 160 | 20 |
| Average porosity of foamed layers in first support and second support (%) | | | | 17 | 17 | 18 | 17 | 17 | 18 | 17 | 19 | 17 |
| Total thickness of thermal transfer image receiving sheet (μm) | | | | 223 | 199 | 273 | 236 | 236 | 298 | 156 | 306 | 143 |
| Evaluation | Curling resistance | Release sheet present | Height difference (mm) | −2 | 0 | −2 | −1 | −1 | −2 | +2 | +2 | −1 |
| | | | Evaluation | A | B | A | A | A | A | Y | Y | A |
| | | Release sheet absent | Height difference (mm) | +4 | +9 | +2 | +7 | +7 | 0 | +20 | +17 | +3 |
| | | | Evaluation | A | B | A | B | B | A | Z | Z | A |
| | Image quality | | | A | B | A | A | A | A | Z | B | Z |
| | Opacity | | | A | B | A | A | A | A | Y | A | Z |

The thermal transfer image receiving sheets of Examples 1 to 6 are resistant to curling, have favorable image quality and have opacity.

On the other hand, the thermal transfer image receiving sheets of Comparative Examples land 2 that do not have a second support were susceptible to curling. Considerable contrast unevenness was observed in the formed image in the case of the thermal transfer image receiving sheet of Comparative Example 1 in particular.

Although the thermal transfer image receiving sheet of Comparative Example 3 not having skin layers was resistant to curling, considerable contrast unevenness was observed in the formed image. In addition, opacity was inferior.

BRIEF DESCRIPTION OF THE REFERENCE SYMBOLS

1 Ink receiving layer
2 First support
3 Adhesive layer
4 Second support
5 Anchor layer
6 Pressure-sensitive adhesive layer
7 Release sheet
8 Antistatic layer
9 Third support
10, 20, 30, 40 Thermal transfer image receiving sheet
21, 41, 91 Foamed layer
22, 42, 92 Skin layer
22*a*, 42*a*, 92*a* One skin layer
22*b*, 42*b*, 92*b* Other skin layer

What is claimed is:

1. A thermal transfer image receiving sheet comprising the lamination of an ink receiving layer, a first support, an adhesive layer and a second support in that order;

the first support and the second support being provided with a foamed layer, and a non-foamed skin layer laminated on both sides of the foamed layer, the adhesive layer comprises a binder resin and a curing agent, each of the first support and the second support having a thickness between 15-140 μm, the basis weight of the adhesive layer is 1 g/m$^2$ to 15 g/m$^2$, and the thermal transfer image receiving sheet having a total thickness of 280 μm or less.

2. The thermal transfer image receiving sheet according to claim 1, wherein the total thickness of the foamed layers in the first support and the second support is 60 μm to 150 μm.

3. The thermal transfer image receiving sheet according to claim 2, wherein a pressure-sensitive adhesive layer and a release sheet are laminated on the side of the second support opposite from the adhesive layer in that order.

4. The thermal transfer image receiving sheet according to claim 2, wherein the thicknesses of the first support and the second support are each 25 μm to 60 μm, and the total thickness thereof is 280 μm or less.

5. The thermal transfer image receiving sheet according to claim 1, wherein a pressure-sensitive adhesive layer and a release sheet are laminated on the side of the second support opposite from the adhesive layer in that order.

6. The thermal transfer image receiving sheet according to claim 5, wherein the thicknesses of the first support and the second support are each 25 μm to 60 μm, and the total thickness thereof is 280 μm or less.

7. The thermal transfer image receiving sheet according to claim 1, wherein the thicknesses of the first support and the second support are each 25 μm to 60 μm, and the total thickness thereof is 280 μm or less.

8. The thermal transfer image receiving sheet according to claim 1, wherein the adhesive layer comprises a polyurethane-based resin, as the binder resin.

9. The thermal transfer image receiving sheet according to claim 1, wherein the average porosity of the foamed layer in the first support and the foamed layer in the second support is 8% to 35%.

10. The thermal transfer image receiving sheet according to claim 1, wherein the curing agent in the adhesive layer includes an isocyanate-based compound.

11. The thermal transfer image receiving sheet according to claim 1, wherein the foamed layer in the first support and the second support has a thickness between 10 μm and 100 μm, and the non-foamed skin layer in the first support and the second support has a thickness between 0.5 μm and 20 μm.

* * * * *